United States Patent [19]

Mathis et al.

[11] 4,395,128

[45] Jul. 26, 1983

[54] MIXING TOWER FOR CONCRETE OR THE LIKE

[75] Inventors: Paul Mathis, Merdingen; Max Zimmer, Efringen-Kirchen, both of Fed. Rep. of Germany

[73] Assignee: Mathis System-Technik GmbH, Merdingen, Fed. Rep. of Germany

[21] Appl. No.: 283,384

[22] Filed: Jul. 15, 1981

[30] Foreign Application Priority Data

Jul. 17, 1980 [DE] Fed. Rep. of Germany ..... 3027069

[51] Int. Cl.[3] ..... B28C 7/04; B28C 9/00

[52] U.S. Cl. ..... 366/18; 366/27; 366/35; 366/37; 366/50; 220/4 D; 222/145; 414/267

[58] Field of Search ..... 366/26, 27, 28, 29, 366/33, 34, 35, 37, 38, 18, 17, 19, 20, 21, 177, 180, 181, 184, 50; 414/267, 268, 269; 220/4 C, 4 D; 222/132, 135, 145

[56] References Cited

U.S. PATENT DOCUMENTS

| | | | |
|---|---|---|---|
| 2,551,216 | 5/1951 | Martin | 220/4 C |
| 2,735,625 | 2/1956 | Preeman | 366/20 |
| 3,343,688 | 9/1967 | Ross | 366/18 |
| 3,385,571 | 5/1968 | Preeman | 366/18 |
| 3,586,180 | 6/1971 | Brock | 414/267 |
| 3,741,440 | 6/1973 | Sanders | 366/18 |

FOREIGN PATENT DOCUMENTS

| | | | |
|---|---|---|---|
| 1114422 | 9/1961 | Fed. Rep. of Germany . | |
| 2360240 | 12/1975 | Fed. Rep. of Germany . | |
| 1367161 | 6/1964 | France | 366/35 |

OTHER PUBLICATIONS

"Beton", vol. 2, p. 64, (1963).

"Fordern und Heben", vol. 2, pp. 65–67, (1960).

*Primary Examiner*—Robert W. Jenkins

*Attorney, Agent, or Firm*—Kontler, Grimes & Battersby

[57] ABSTRACT

A mixing tower for concrete or the like has a series of superimposed prefabricated modules which are connected to one another and include a cylindrical lowermost module, a frustoconical intermediate module with several outlets which is integral with the top of the lowermost module, and several larger-diameter cylindrical modules above the intermediate module. The modules contain prefabricated mixers, controls, scales and/or analogous aggregates which are assembled with the respective modules at the manufacturing plant and are coupled to each other at the locus of erection of the tower, preferably by coupling devices each of which is disposed at the level of connection between the respective modules. A separate silo can be erected next to the tower and is then provided with an inlet for transfer of surplus concrete or the like from the intermediate module of the tower as well as with an outlet which can discharge the finished product into a truck simultaneously with admission of concrete into such truck from an outlet of the intermediate module.

23 Claims, 3 Drawing Figures

MIXING TOWER FOR CONCRETE OR THE LIKE

BACKGROUND OF THE INVENTION

The present invention relates to the making of green (freshly mixed) concrete, plaster, dry mortar or like building materials. More particularly, the invention relates to improvements in mixing towers wherein the ingredients of such building materials are stored and processed to yield a final or ultimate product which can be transported to the locale or locales of use.

It is already known to assemble a mixing tower for concrete or the like from several superimposed sections which contain various aggregates serving for the storage and/or processing of ingredients or constituents of the ultimate product, e.g., for storage of portland cement and water, for mixing of such ingredients, for metering the quantities of ingredients to be mixed, for storing a supply of freshly mixed concrete, for dispensing freshly mixed concrete and for controlling or regulating the sequence of operations when the tower is in actual use. An advantage of mixing towers with superimposed sections is that at least some of the ingredients of the final product (hereinafter referred to as concrete with the understanding, however, that the tower can be used with equal advantage for the making of other materials such as dry mortar, plaster and the like) can descend by gravity. This entails considerable savings in energy and space when compared with mixing systems wherein various components or units are disposed at the same level, one next to the other. The placing of various reservoirs, mixers and/or other units side by side rather than above each other necessitates the use of numerous conveyors which transport the ingredients between several units as well as a large number of pipes which connect at least some of the units to each other, and requires practically constant attention by one or more workmen.

A drawback of presently known mixing towers with superimposed aggregates is that the aggregates must be installed in a frame which surrounds the aggregates and supports them at different levels. The frame is assembled of numerous parts which must be transported to and connected to each other at the locale of erection of the tower. Also, the installation of various aggregates at different levels of the frame is a time-consuming operation which necessitates the utilization of cranes and other highly expensive equipment for long periods of time. Furthermore, it is necessary to employ skilled persons at the locus of erection, and such skilled persons must be in attendance for extended periods of time.

OBJECTS AND SUMMARY OF THE INVENTION

An object of the invention is to provide a novel and improved mixing tower which is designed in such a way that at least the majority of its components can be completed in the manufacturing plant proper so that the period of time which is needed for erection at the locale of use is a small fraction of the time which is required for the erection of conventional mixing towers.

Another object of the invention is to provide a mixing tower which exhibits all advantages of heretofore known mixing towers with gravitational transport of ingredients to various aggregates but is devoid of the drawbacks of such conventional mixing towers.

A further object of the invention is to provide a mixing tower which can be rapidly assembled as well as rapidly taken apart for transfer to a different locale of use or to storage.

An additional object of the invention is to provide a mixing tower of the above outlined character which is constructed, configurated and assembled in such a way that it is readily accessible to several vehicles, including bulky or extremely bulky trucks for long-distance hauling of freshly mixed concrete, and which can be placed close to or into immediate proximity of a silo for temporary storage of surplus concrete.

Still another object of the invention is to provide a mixing tower which is constructed in such a way that the coupling of various aggregates in its interior can take place substantially simultaneously with assembly of the corresponding exposed constituents of the tower.

Another object of the invention is to provide the mixing tower with a novel and improved supporting frame or shell for various mixing, storage, programming and/or other aggregates.

The invention is embodied in a mixing tower for the production of green (freshly mixed) concrete, dry mortar or like materials, especially building materials which can be used to bond bricks, rocks or the like, for the pouring of foundations and/or for analogous purposes. The mixing tower comprises a plurality of superimposed prefabricated tubular modules and means for connecting the neighboring modules to one another. The modules may include at least one mixer module for the ingredients of the ultimate product, at least one module with a metering device or scale for such ingredients, at least one module which constitutes or contains a reservoir for at least one of the ingredients (for example, a reservoir for portland cement), at least one module for a control unit which can select and determine the sequence of the metering, mixing and other operations, and at least one module for one or more devices which discharge finished material into conveyances, e.g., into silo trucks or analogous road vehicles.

At least one of the modules preferably constitutes a cylinder, i.e., it has a substantially circular cross-sectional outline.

Savings in ground space can be achieved if the lowermost module is a relatively slender tube or cylinder and if the modules include at least two additional modules disposed at a level above the lowermost module and constituting cylinders with identical or nearly identical diameters which are larger than the diameter of the lowermost module. It is preferred to make the lowermost module integral with an intermediate module which is provided with one or more outlets for the finished product, which may constitute a hollow conical frustum, and which is disposed at a level below the additional modules.

The mixing tower preferably further comprises prefabricated aggregates which are installed in at least one of the modules. Such aggregates may include at least one metering device for the ingredients of the ultimate product, at least one mixing device for some or all of these ingredients, at least one reservoir for the ingredients (for example, a reservoir for water and a reservoir for cement), and at least one reservoir for the ultimate product. The aggregates in the neighboring modules are preferably secured to each other by coupling means which are disposed substantially or exactly at the level of connecting means between the respective modules. This renders it possible to manipulate such coupling means simultaneously with or immediately prior to connection of the respective tubular modules to one another.

As mentioned above, the modules preferably comprise a lowermost module which may constitute a slender upright cylinder and whose transverse dimensions are less than those of some or all of the modules thereabove. The aforementioned intermediate module which may be integral with the lowermost module and which may be made of one piece with the lowermost module can have several outlets for the finished product and it can constitute a transition between the lowermost module and the larger-diameter additional modules thereabove. This renders it possible to move several road vehicles into immediate proximity of the lowermost module and to begin with the transfer of finished product into one of the vehicles as soon as the other vehicle has been filled to a desired extent. The intermediate module can have at least two outlets which are disposed at least substantially diametrically opposite each other with reference to the axis of the preferably cylindrical lowermost module.

Another feature of the invention resides in the provision of a combination which includes the aforediscussed improved mixing tower and a discrete reservoir or silo for the finished product. The intermediate module of the tower can be connected with the silo by a suitable conveyor (e.g., a conveyor having one or more feed screws) for transfer of finished product into the silo when the conveyances are not available or cannot remove the entire output of the mixing tower. In order to allow for evacuation of the contents of the silo, the latter is preferably provided with at least one outlet which can be positioned, with reference to an outlet of the intermediate module, in such a way that a vehicle which is driven into the space between the tower and the silo can simultaneously or alternately receive freshly mixed concrete or the like from an outlet of the tower and from the outlet of the silo.

The novel features which are considered as characteristic of the invention are set forth in particular in the appended claims. The improved mixing tower itself, however, both as to its construction and the mode of assembling the same as well as its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 2:
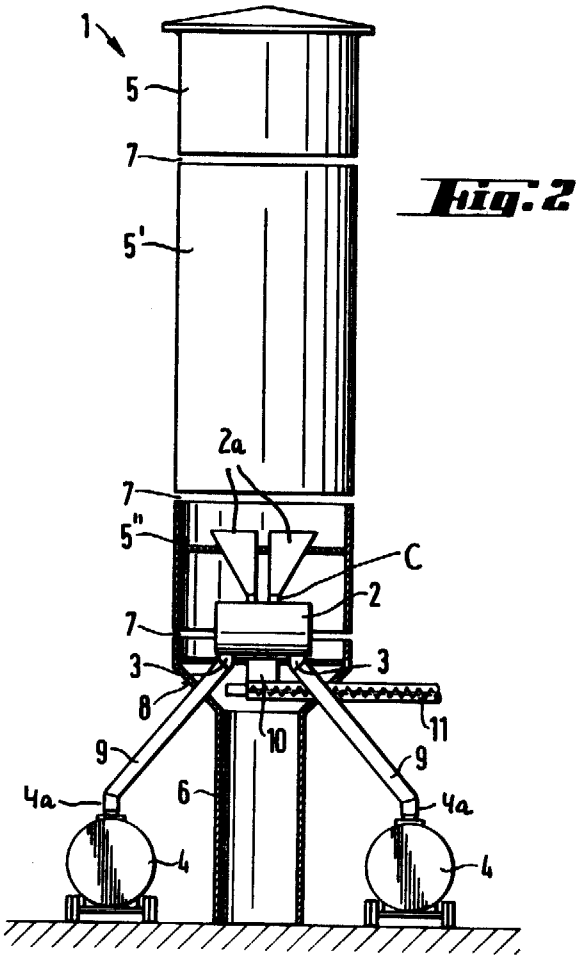
FIG. 2 is a partly elevational and partly sectional view of the mixing tower, substantially as seen in the direction of arrows from the line II—II of FIG. 1.
Figure 1:
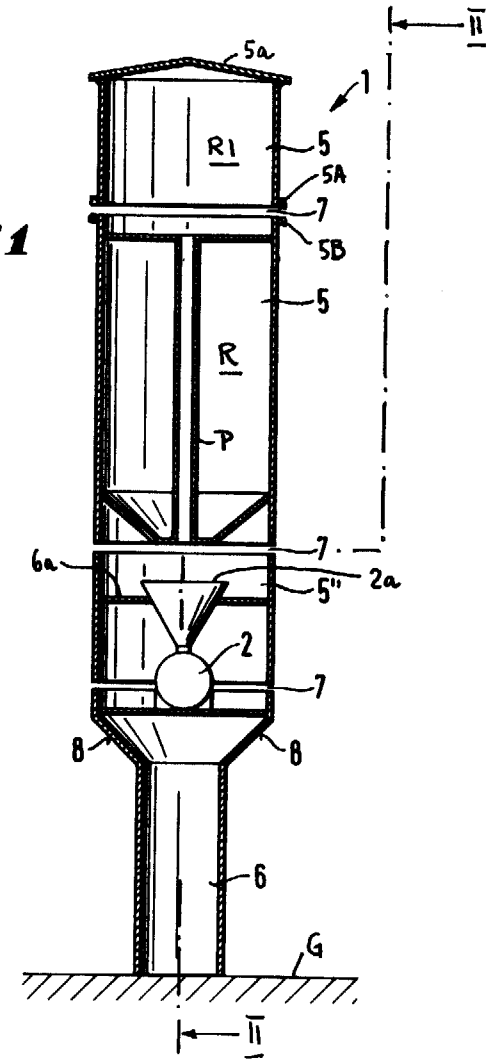
FIG. 1 is a schematic central vertical sectional view of a mixing tower which embodies the invention.

Referring first to FIGS. 1 and 2, there is shown a mixing tower 1 which is assembled of a plurality of superimposed prefabricated tubular modules, i.e., each such module can be completed at the plant and the prefabricated modules are simply connected to each other at the locale of actual use. For the sake of clearer illustration, the prefabricated modules of the mixing tower 1 are shown in spaced-apart positions, i.e., with clearances 7 between neighboring modules. The modules include a relatively short cylindrical topmost module 5 with a roof 5*a*, another cylindrical module 5' which is disposed below the topmost module 5, a third cylindrical module 5'' which is disposed below the module 5', a cylindrical lowermost module 6 which is mounted on or anchored in the ground G, and an at least partly frustoconical intermediate module 8 which is integral with the lowermost module 6 and is disposed below the module 5''. The diameters of the modules 5, 5' and 5'' are identical or nearly identical and exceed the diameter of the lowermost module 6. The means for connecting the neighboring modules to each other may comprise flanges (such as those respectively shown at 5A, 5B at the lower end of the module 5 and at the upper end of the module 5') and suitable bolts, screws or other fasteners for connecting the flanges to each other. It is clear that, when the neighboring modules are properly connected with each other, the clearances 7 are reduced to zero and the modules together constitute a preferably fluidtight or substantially fluidtight shell for various aggregates which are installed in their interior and are preferably coupled to each other in the regions of the respective connecting means, i.e., in the regions of the respective clearances 7, to simplify the task of persons who are in charge of assembling the mixing tower 1.

The aggregates in the various modules of the mixing tower 1 are or can be installed in the respective modules at the manufacturing plant to further reduce the period of time which is needed for erection of the tower at the locale of use. Such aggregates may include a reservoir R for cement, a reservoir R1 for water, and a mixer 2 which is installed in the module 8 and is separably coupled with two funnels 2*a* held by a horizontal partition 6*a* in the module 5''. The coupling means between the aggregates 2 and 2*a* are shown at C. Other aggregates may include one or more control units (not specifically shown) which determine the sequence of operations which must be carried out to maintain in the mixer 2 an adequate supply of fresh concrete, scales and/or metering devices for various ingredients, pipes (such as the pipe P) which serve to convey certain ingredients by gravity flow and/or others. All that counts is to ensure that as many aggregates as practicable be assembled with the respective modules at the manufacturing plant so that the time of assembly of the tower 1 at the locus of use is a small fraction of the period of time which is needed for assembly of conventional mixing towers or mixing systems.

FIG. 2 shows that the intermediate module 8 has two outlets 3 for evacuation or discharge of finished product into conduits 9 leading to the intakes of two road vehicles 4 parked in close or immediate proximity of the lowermost module 6. FIG. 2 further shows that the outlets 3 are disposed substantially diametrically opposite each other with reference to the axis of the module 6. Since the diameter of the module 6 is smaller than those of the modules 5, 5' and 5'', there is ample room for driving the vehicles 4 very close to the module 6. This is advisable and advantageous because the intakes 4*a* of the vehicles 4 can be moved close to the respective outlets 3 so that the tower 1 can employ relatively short conduits 9 for transfer of concrete into the holds of the vehicles 4.

It goes without saying that the diameters of the sections 5, 5' and 5" need not be exactly identical, i.e., at least one of these sections can be provided with outwardly or inwardly bulging portions, doors, windows or the like to accomodate a specific aggregate and/or to afford convenient access to the aggregate or aggregates in such module. Cylindrical modules are preferred at this time because the ratio of their capacities to their transverse dimensions is more satisfactory than that of polygonal modules. These modules may be made of steel or another suitable metallic material.

The placing of coupling means between neighboring aggregates at the levels of the clearances 7 (i.e., in the regions of connecting means between neighboring modules) is advisable and advantageous because a person who wishes to work on or in the region of a connecting means is also in a position to attend (if necessary) to the respective coupling means. The majority of coupling means will include connections between various pipes P, conduits 9 and/or the like.

The lowermost module 6 may consist of two or more cylindrical sections and, as shown in FIGS. 1 and 2, the upper end portion of this module can be made of one piece with the intermediate module 8. This further simplifies the assembly of the tower 1 at the locale of use and does not present serious problems during transport of modules to such locale since the weight of the module 6 (or the combined weight of the modules 6, 8) may be a minute fraction of the weight of a relatively bulky large-diameter module 5, 5' or 5", especially if the tower 1 is relatively small.

One of the vehicles 4 can be held in a position of readiness to receive freshly mixed concrete as soon as the other vehicle 4 has been filled to capacity or to a desired extent. This reduces the intervals of idleness and renders it possible to operate the tower practically without interruptions, especially if the mixer 2 constitutes or includes a reservoir which can store a certain quantity of concrete while the tower is in use and the freshly filled vehicle is being disconnected from the intermediate module 8, i.e., from the respective outlet 3. It is also within the purview of the invention to design the evacuating means of the tower 1 in such a way that several road vehicles or other types of conveyances can be loaded simultaneously. It is advisable to design the evacuating system of the tower 1 in such a way that the latter need not be idled for the sole purpose of enabling an empty vehicle to take the place of a freshly filled vehicle.

Figure 3:
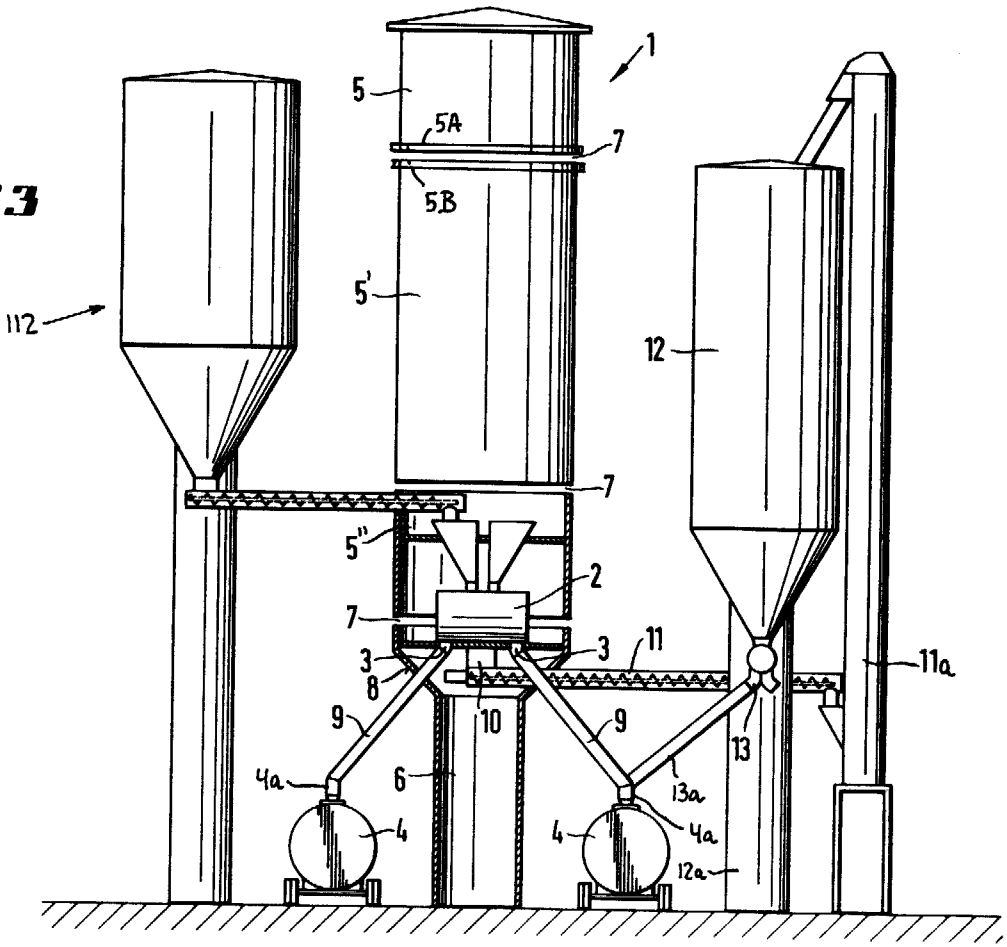
FIG. 3 is a partly elevational and partly vertical sectional view of the improved tower, further showing a silo for temporary storage of fresh concrete, a second silo for storage of one or more ingredients of the ultimate product, and two vehicles for transport of freshly mixed concrete.

FIG. 3 shows the mixing tower 1 of FIGS. 1 and 2 and a second upright tower 12 which constitutes a silo for temporary storage of concrete. Such concrete is supplied by a horizontal screw conveyor 11 which is connected with a third outlet 10 of the module 6 and delivers concrete into an upright conveyor 11*a* for delivery into an inlet at the top portion of the silo 12. The latter has an outlet 13 at the level of outlets 3 in the module 8 and conduit means 13*a* for connecting the outlet 13 with a vehicle 4 which is driven into the space substantially midway between the module 6 and the slender cylindrical lower part 12*a* of the silo 12. Thus, a vehicle 4 which is properly positioned for reception of concrete from the mixer 2 of the tower 1 is also properly positioned for reception of material from the silo 12. The silo 12 can be installed very close to the tower 1, especially if its lower part 12*a* is also of smaller diameter than the remaining section or sections, because the relatively small diameters of the lower part 12*a* and module 6 still provide adequate space for a vehicle 4 therebetween.

The purpose of the silo 12 is to accept the output of the mixing tower 1 in the absence of a continuous series of vehicles 4 or in the absence of any vehicles when the operators deem it necessary to accumulate a supply of freshly mixed concrete. Furthermore, the silo 12 can be used for loading of vehicles while the mixing tower 1 is idle, e.g., for the purpose of inspection and/or repair and/or replenishing of the supplies of ingredients of the ultimate product. Placing of the silo 12 close to the mixing tower 1 is desirable for the aforementioned reasons as well as on the additional ground that the dimensions of the conveyor 11 can be reduced accordingly.

The device 112 at the left-hand side of the tower 1 shown in FIG. 3 can constitute a discrete vessel or silo for storage of a certain ingredient of concrete, e.g., it may constitute a water tower which admits metered quantities of water into the mixer 2 when the tower 1 is in use.

An important feature of the improved mixing tower 1, as well as of the combination of such mixing tower with the silo 12 and conveyor means 11, 11*a*, is that it exhibits all advantages of conventional mixing towers wherein the ingredients of concrete can descend by gravity and which occupy a minimum of ground space, as well as that it avoids the drawbacks of conventional mixing towers, especially as concerns the interval of time which is required for erection at the locale of use. Moreover, the output of the improved mixing tower matches the output of a much larger conventional mixing tower; this renders it possible to greatly reduce the dimensions of the mixing tower if its capacity need not be overly large or to produce much more concrete at a cost which is a fraction of the cost of production of concrete in conventional mixing towers. If the dimensions of the improved mixing tower are reduced, this evidently entails a proportional reduction of the initial cost, assembly cost at the plant, as well as of the cost of erection at the locale of use. The making of modules in the plant, as well as partial or even practically complete assembly of modules with the respective mixing, regulating, metering, conveying and/or other aggregates at the plant, is much less expensive and cumbersome than at the locale of use because skilled attendants are more likely to be available at the plant and the erection takes less time so that it is much less dependent on climatic conditions than in connection with the erection of conventional mixing towers. This will be readily appreciated since a relatively short period of satisfactory weather will suffice to allow for complete erection and assembly of the improved mixing tower whereas such relatively short period would merely suffice for the assembly of a small fraction of a conventional mixing tower. The modules are dimensioned in such a way that they can be readily transported to the locus of use by resorting to available transportation. The installation of aggregates in the respective modules prior to transport to the locale of use also saves time, labor and expenses because this, too, contributes to more rapid erection of the mixing tower.

As mentioned above, cylindrical modules are preferred at the present time because of the highly satisfactory ratio of their weight and capacity to space requirements and cost. However, this does not preclude the utilization of one or more modules which are not exactly cylindrical or which include cylindrical as well as polygonal portions.

A further important and desirable feature of the improved mixing tower is that it allows for the driving of conveyances into immediate or close proximity of the outlet or outlets which are preferably provided in the intermediate module 6, i.e., in the section which connects the smaller-diameter lowermost module with the larger-diameter modules thereabove. The utilization of a smaller-diameter lowermost section does not or need not affect the stability of the tower; however, it contributes significantly to accessibility of the outlet or outlets in the module 8. Thus, each of the vehicles 4 can be driven so close to the module 6 that a portion of each vehicle is actually located below the larger-diameter portion of the module 8 and hence below the modules 5, 5' and 5''. Two vehicles can be loaded simultaneously or immediately after one another irrespective of whether the module 8 has a single discharging aggregate or unit with several outlets or several discharging units or aggregates each of which has a single outlet. The advantages of providing room for two or more vehicles next to the module 6 will be readily apparent, i.e., one of the vehicles can be loaded at a maximum speed while the other vehicle is being connected to the respective outlet 3 for immediate reception of concrete as soon as the loading of the one vehicle is completed so that the speed of operation of the various aggregates in the mixing tower need not be reduced on completion of loading of the one vehicle. In other words, the loading of successive vehicles can take place at a rate which corresponds to the maximum rate of production of concrete in the improved mixing tower. Since the lowermost module 6 can serve as the sole means for carrying and adequately supporting the other modules, i.e., since there is no need for any props, braces, struts, guy wires or the like, the vehicles 4 can be driven very close to the module 8 with attendant savings in space and the possibility of installing the silo 12 in immediate proximity of the tower 1.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A mixing tower for the production of concrete, dry mortar and like materials comprising:

a plurality of prefabricated, superimposed modules including a lowermost module which constitutes at least the predominant source of support for the remainder of said modules and a mixing module having a mixing device for mixing ingredients to form a flowable product, said lowermost module being in direct contact with a selected module supported by the same, and said lowermost module having a maximum transverse dimension as considered along a predetermined direction which is smaller than the corresponding maximum dimension of said selected module so that the latter projects to at least two sides of said lowermost module, at least one of said modules being provided with outlet means for discharging the product formed in said mixing module to transport means.

2. The mixing tower of claim 1, wherein said modules include at least one module containing a scale for the ingredients, at least one reservoir for at least one of the ingredients, and at least one module for a control unit.

3. The mixing tower of claim 1, wherein at least one of said modules has a circular cross-sectional outline.

4. The mixing tower of claim 3, wherein said plurality of modules comprises at least two modules at a level above said one module, said two modules having at least substantially identical diameters.

5. The mixing tower of claim 1 comprising prefabricated aggregates installed in at least some of said modules.

6. The mixing tower of claim 5, wherein said aggregates include said mixing device and at least one metering device for the ingredients.

7. The mixing tower of claim 5, further comprising means for coupling the aggregates in neighboring modules to one another, said coupling means being disposed at least substantially at the levels of the joints between the respective modules.

8. The mixing tower of claim 1, wherein said lowermost and selected modules constitute a prefabricated unit.

9. The mixing tower of claim 1, wherein said selected module is said mixing module.

10. The mixing tower of claim 1, wherein said lowermost module constitutes essentially the sole support for said remainder of said modules.

11. The mixing tower of claim 1, wherein said modules are tubular.

12. The mixing tower of claim 1, wherein the cross-sectional area of said lowermost module is smaller than that of said selected module.

13. The mixing tower of claim 1, wherein said one module is said selected module.

14. The mixing tower of claim 1, wherein said plurality of modules includes at least one reservoir for the ingredients and at least one reservoir for the product.

15. The mixing tower of claim 1, wherein said outlet means is arranged to discharge the product to each of said sides.

16. The mixing tower of claim 1, wherein said plurality of modules includes a predetermined module which is disposed above said selected module; and further comprising connecting means for connecting said selected module to said predetermined module.

17. The mixing tower of claim 1, wherein said lowermost and selected modules are of one piece.

18. An arrangement for the production of concrete, dry mortar and the like comprising:

(a) a mixing tower which includes a plurality of prefabricated, superimposed modules, said plurality of modules comprising a lowermost module which constitutes at least the predominant source of support for the remainder of said modules and a mixing module having a mixing device for mixing ingredients to form a flowable product, said lowermost module being in direct contact with a selected module supported by the same, and said lowermost module having a maximum transverse dimension as considered along a predetermined direction which is smaller than the corresponding maximum dimension of said selected module so that the latter projects to at least two sides of said lowermost module, at least one of said modules being provided with an outlet for evacuation of the product formed in said mixing module from said mixing tower;

(b) a silo for the product; and (c) transport means for conveying the product from said mixing tower to said silo.

19. The arrangement of claim 18, wherein said silo has at least one additional outlet; and further comprising means for transferring the product from said outlets to a vehicle between said tower and said silo.

20. A mixing tower for the production of concrete, dry mortar or like materials, comprising a plurality of superimposed, prefabricated tubular modules including a lowermost module having transverse dimensions smaller than the dimensions of the modules thereabove, a second module, and a third module intermediate said second and lowermost modules, said third module having at least one outlet for the ultimate product; and means for connecting said second and third modules to one another.

21. The mixing tower of claim 20, wherein said second module is a cylinder and said third module is a hollow conical frustum.

22. The mixing tower of claim 20, wherein said third module has at least two outlets.

23. The mixing tower of claim 22, wherein said outlets are disposed substantially diametrically opposite each other with reference to the axis of said lowermost module.

* * * * *